US010259214B2

(12) United States Patent
Takata

(10) Patent No.: US 10,259,214 B2
(45) Date of Patent: Apr. 16, 2019

(54) IMAGE FORMING DEVICE FOR REDUCING THE NUMBER OF INK-DISCHARGING OPERATIONS

(71) Applicant: RISO KAGAKU CORPORATION, Tokyo (JP)

(72) Inventor: Atsushi Takata, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/812,355

(22) Filed: Nov. 14, 2017

(65) Prior Publication Data

US 2018/0141331 A1 May 24, 2018

(30) Foreign Application Priority Data

Nov. 24, 2016 (JP) ..... 2016-227418

(51) Int. Cl.
*B41J 2/045* (2006.01)
*B41M 1/12* (2006.01)

(52) U.S. Cl.
CPC ..... *B41J 2/04513* (2013.01); *B41J 2/0451* (2013.01); *B41J 2/0458* (2013.01); *B41J 2/04536* (2013.01); *B41J 2/04581* (2013.01); *B41M 1/12* (2013.01)

(58) Field of Classification Search
CPC .. B41J 2/04513; B41J 2/0451; B41J 2/04536; B41J 2/04581; B41J 2/0458; B41M 1/12
See application file for complete search history.

(56) References Cited

U.S. PATENT DOCUMENTS

2011/0181658 A1 7/2011 Izawa et al.
2016/0052263 A1* 2/2016 Edamura ..... B41J 2/2054 347/14

FOREIGN PATENT DOCUMENTS

JP 2010-99955 5/2010

* cited by examiner

*Primary Examiner* — Henok D Legesse
(74) *Attorney, Agent, or Firm* — Greenblum & Bernstein, P.L.C.

(57) ABSTRACT

An image forming device includes an inkjet head unit, a count acquiring section, a determining section, and a head controlling section. The inkjet head unit includes an element. The count acquiring section acquires, based on job data, an element operation count of the element. The determining section determines whether the element operation count is equal to or greater than a warning threshold count that is smaller by a predetermined count than a life threshold count corresponding to a life end point of the element. The head controlling section controls, when the element operation count is equal to or greater than the warning threshold count, the inkjet head unit to form an image by suppressing the element operation count.

6 Claims, 7 Drawing Sheets

IMAGE FORMING DEVICE FOR REDUCING THE NUMBER OF INK-DISCHARGING OPERATIONS

CROSS REFERENCE TO RELATED APPLICATION

This application claims benefit of priority under 35 U.S.C. § 119 to Japanese Patent Application No. 2016-227418, filed on Nov. 24, 2016, the entire contents of which are incorporated by reference herein.

BACKGROUND OF THE INVENTION

1. Field of the Invention

The present invention relates to an image forming device that includes a head unit having an element and forms an image by an element operation of the element.

2. Description of the Related Art

Conventionally, a configuration that includes a head unit having an element for forming an image is widely used in image forming devices such as inkjet printing machines and stencil printing machines.

For example, in the inkjet printing machine, an element operation of the element causes the head unit to discharge ink and form an image on a recording medium such as paper sheet.

The above-described element, when operated for a prescribed number of times, deteriorates and stops functioning properly. As a result, the quantity of the ink discharged reduces, which lowers the image quality remarkably. Due to this, a life end point (expire time) is set to the head unit, wherein the life end point indicates that the head unit needs to be replaced.

As a method for calculating the life end point of the head unit, for example, various techniques, such as determining the life end point based on the number of times the ink has been discharged by the element operation, has been used (for example, refer to Patent Document 1: Japanese Patent Application Laid-Open No. 2010-99955).

When the life end point of the head unit is determined using the technique disclosed in Patent Document 1, it is a common practice to set the head unit to an usable state at this time because a remarkably low print quality is obtained unless the head unit is replaced with a new one.

It is required to develop a mechanism that continuously performs printing for a longer time without remarkably lowering the print quality even when the head unit is near its life end point.

SUMMARY OF THE INVENTION

The present invention has been made in view of the above circumstances. It is an object of the present invention to provide an image forming device that continuously performs printing for a longer time without remarkably lowering the print quality even when a head unit is near its life end point.

According to first aspect of the present invention, there is provided an image forming device that forms an image by an element operation of an element including: a head unit including the element; and a processor that acquires an element operation count of the element based on job data that instructs to form the image, determines whether the element operation count is equal to or greater than a warning threshold count that is smaller by a predetermined count than a life threshold count corresponding to a life end point of the element, and controls the head unit to form the image by suppressing the element operation count when the element operation count is equal to or greater than the warning threshold count.

According to a second aspect of the present invention, there is provided the image forming device, wherein, when controlling the head unit to form the image by suppressing the element operation count, the processor performs either a thinning process in which pixels that constitute the image are thinned out or a pixel density reducing process in which pixel density of the image is reduced, to generate from the job data modified image data in which the element operation count is suppressed, and controls the head unit based on the generated modified image data.

According to a third aspect of the present invention, there is provided the image forming device, wherein, the processor receives an instruction from a user whether the image is to be formed by suppressing the element operation count when the element operation count is equal to or greater than the warning threshold count, and controls the head unit to form the image by suppressing the element operation count when the element operation count reaches or exceeds the warning threshold count and the processor receives from the user the instruction that the image is to be formed by suppressing the element operation count.

According to the first aspect of the present invention, the processor acquires the element operation count and determines whether the element operation count is equal to or greater than the warning threshold count that is smaller by the predetermined count than the life threshold count. Moreover, when the element operation count is equal to or greater than the warning threshold count, the processor controls the head unit to form the image by suppressing the element operation count.

With this configuration, in the image forming device, when the element operation count has reached or exceeded the warning threshold count that is smaller by the predetermined count than the threshold count, the image can be formed by suppressing the element operation count, and as a result, life of the head unit can be extended even before the life end point. Accordingly, it becomes possible to continuously print for a longer time without remarkably lowering the print quality even when the element operation count has reached or exceeded the warning threshold count and the head unit is near its life end point.

According to the second aspect of the present invention, to control the head unit to form the image by suppressing the element operation count, the processor generates the modified image data in which the element operation count is suppressed by performing either the thinning process that thins out the pixels that constitute the image or the pixel density reducing process that suppresses the pixel density of the image, and controls the head unit based on the generated modified image data. Even in such a case, the life of the head unit can be extended.

According to the third aspect of the present invention, when the element operation count is equal to or greater than the warning threshold count, the processor receives the instruction from the user whether to form the image by suppressing the element operation count or not. Moreover, when the element operation count reaches or exceeds the warning threshold count and the processor receives the instruction that the image is to be formed by suppressing the element operation count, the processor controls the head unit to form the image by suppressing the element operation count. Accordingly, in the image forming device, because the user can select whether the image is to be formed by suppressing the element operation count or without suppressing the element operation count, degree of freedom of selection can be increased and convenience offered to the user can be improved.

DESCRIPTION OF THE EMBODIMENTS

Exemplary embodiments of the present invention will be described below in detail with reference to the accompanying drawings. The following embodiments present examples of an apparatus and the like for realizing the technical concept of the present invention. The technical concept of the present invention is not limited to the arrangement and the like of various structural components in the following embodiments. Various modifications can be made in the technical concept of the present invention within the scope of claims.

First Exemplary Embodiment (Configuration of Image Forming Device)

Figure 1:
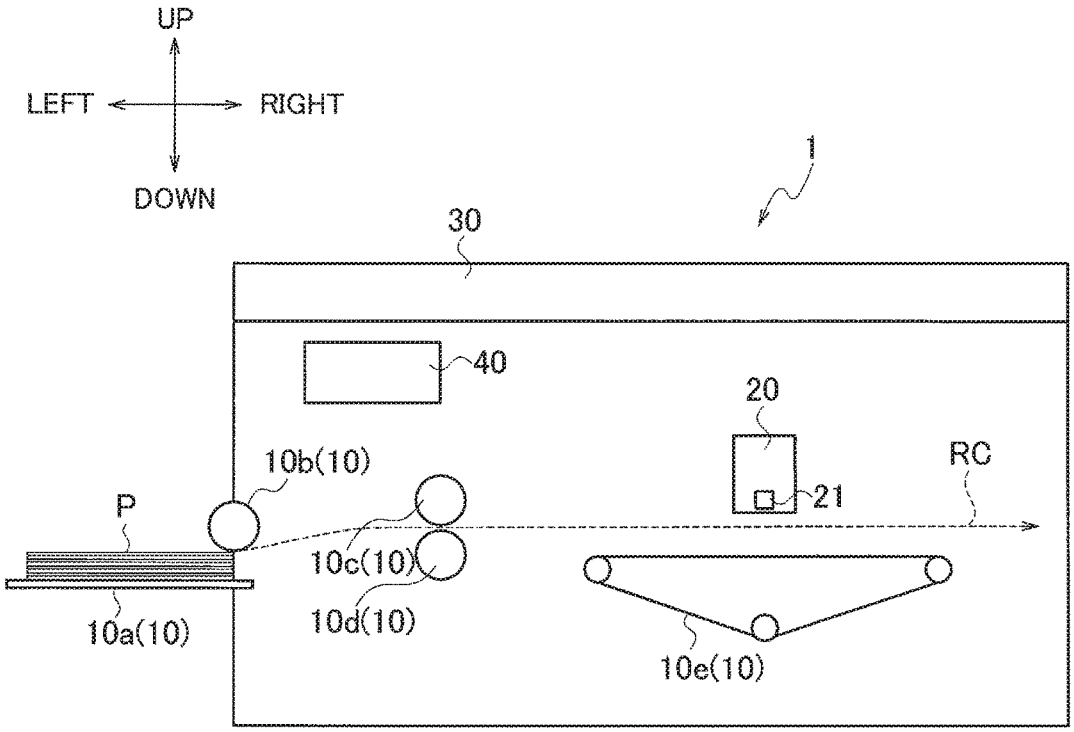
FIG. 1 is a schematic structural diagram of an image forming device according to a first exemplary embodiment of the present invention.

FIG. 1 is a schematic structural diagram of a configuration of an image forming device 1 according to a first exemplary embodiment of the present invention. In the following description, as shown in FIG. 1, up, down, left, and right depicted in FIG. 1 refer to up, down, left, and right directions respectively. In FIG. 1, a path indicated by a broken line is a conveying path RC via which a paper sheet P, that is a recording medium, is conveyed and a direction from the left to the right is a conveying direction.

The image forming device 1 forms an image by an element operation of each of elements 21 which will be described later.

As shown in FIG. 1, the image forming device 1 includes a paper feeding/conveying unit 10, an inkjet head unit 20, an operation panel 30, and a main controlling unit 40.

The paper feeding/conveying unit 10 feeds and conveys the paper sheet P along the conveying path RC. The paper feeding/conveying unit 10 includes a paper feeding tray 10*a*, a paper feeding roller 10*b*, resistance rollers 10*c* and 10*d*, and a conveyer belt 10*e*.

The paper sheet P, that is a recording medium on which an image is to be formed, is loaded on the paper feeding tray 10*a*. The paper sheet P is a white paper.

The paper feeding roller 10*b* picks up the paper sheets P loaded on the paper feeding tray 10*a* one by one and conveys the paper sheets P toward the resistance rollers 10*c* and 10*d*. The paper feeding roller 10*b* is arranged above the paper feeding tray 10*a*. The paper feeding roller 10*b* is rotationally driven by a motor (not shown).

The resistance rollers 10*c* and 10*d* temporarily stop the paper sheet P conveyed by the paper feeding roller 10*b* and then convey the paper sheet P toward the conveyer belt 10*e* while nipping (catching) the paper sheet P between the rollers. The resistance rollers 10*c* and 10*d* are arranged at a downstream side viewed from the paper feeding roller 10*b*. The resistance rollers 10*c* and 10*d* are rotationally driven by a motor (not shown).

The conveyer belt 10*e* is an annular belt that is stretched around a plurality of rollers. A plurality of belt holes (not shown) for sucking and holding the paper sheet P is formed on the conveyer belt 10*e*. The conveyer belt 10*e* sucks and holds the paper sheet P by a suction force generated in the belt holes by driving of a fan (not shown). The conveyer belt 10*e* rotates by the driving action of the rollers, and conveys the sucked and held paper sheet P along the conveying path RC.

The inkjet head unit 20 is a linear inkjet head unit in which a plurality of nozzles is lined in a direction that is substantially perpendicular to the conveying direction of the paper sheet P (front-back direction in the drawing). The inkjet head unit 20 is arranged above the conveyer belt 10*e*. The inkjet head unit 20 discharges ink from an inkjet head onto the paper sheet P conveyed by the conveyer belt 10*e* to print an image on the paper sheet P. Black ink is discharged from the inkjet head unit 20. However, the color of the ink to be discharged is not limited to black, and ink of other color may be used.

The inkjet head unit 20 includes a plurality of the elements 21. Specifically, the inkjet head unit 20 includes the elements 21 corresponding to the nozzles. The inkjet head unit 20 discharges an ink drop from a nozzle by an element operation of the corresponding element 21.

A heat element used in a thermal type configuration, a piezoelectric element used in a piezoelectric type configuration, and the like are examples of the element 21.

For example, in the case where the element 21 is a heat element, the element 21 generates heat when energized, which in turn generates foam in the ink supplied to the inkjet head unit 20. Therefore, the inkjet head unit 20 discharges the ink drop from the nozzle by the action of the foaming pressure generated by the element 21.

Moreover, for example, in the case where the element 21 is a piezoelectric element, the element 21 is deformed by applying voltage thereon. The inkjet head unit 20 discharges the ink drop from the nozzle by the force generated because of the deformation of the element 21.

The ink discharged by the element operation of the elements 21 described above, lands on the paper sheet P to form an image constituted by ink dots.

The operation panel 30 receives operations input by a user and displays thereon various information and the like. The operation panel 30 includes an input section (not shown) that has operation buttons, a touch screen, and the like for the user to perform various input operations, and a display section (not shown) constituted by a liquid crystal display and the like for displaying the various information and the like.

The main controlling unit 40 controls operations of various units of the image forming device 1. The main controlling unit 40 includes CPU (processor), RAM, ROM, a hard disk, and the like. The main controlling unit 40 realizes various control processes using the CPU which reads a control program. The main controlling unit 40 receives job data transmitted from a terminal device 2, and controls the paper feeding/conveying unit 10 and the inkjet head unit 20 based on the received job data to form an image on the paper sheet P.

(Configuration of Main Controlling Unit)

Figure 2:
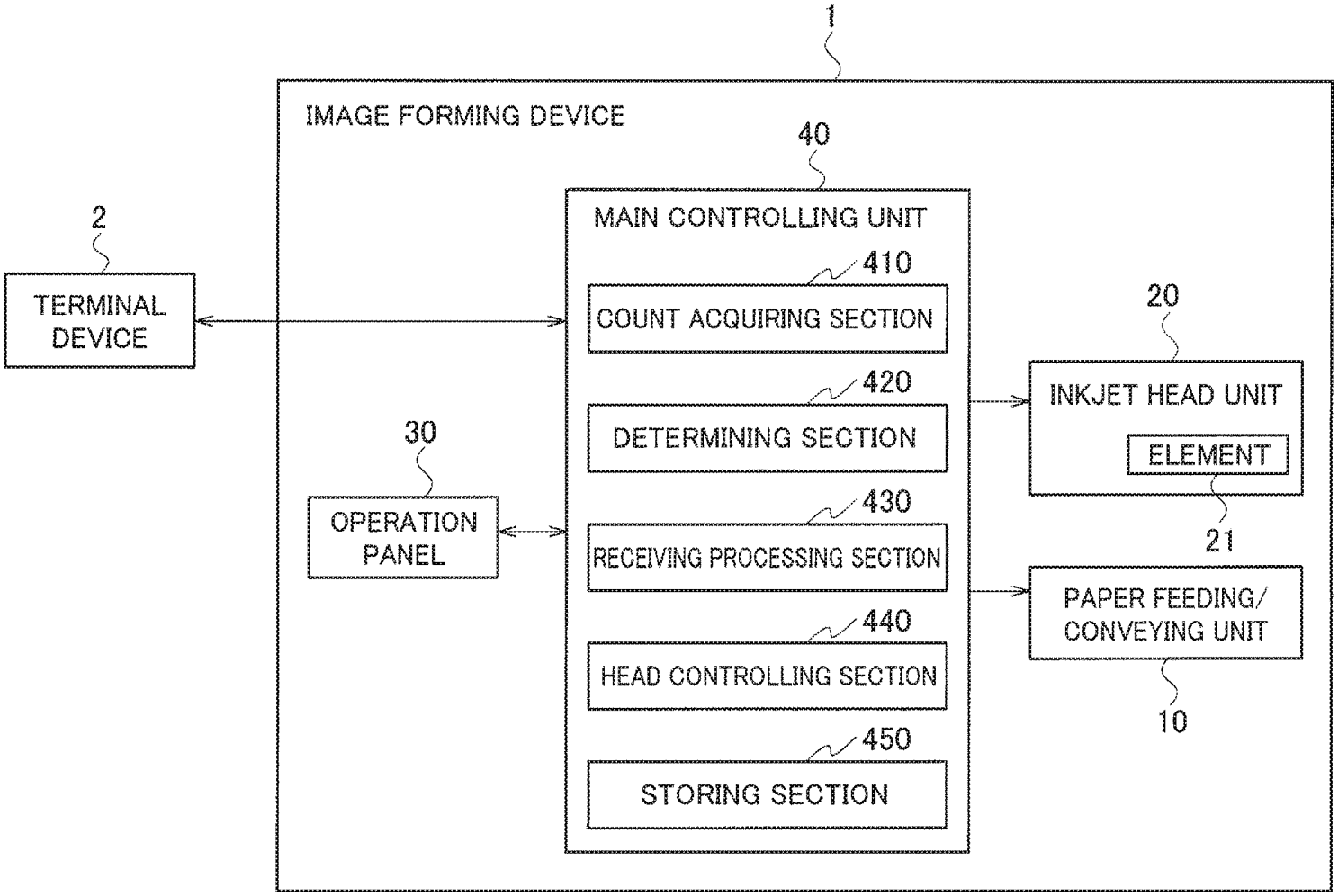
FIG. 2 is a block diagram showing an overview of functions of the image forming device according to the first exemplary embodiment of the present invention.

Configuration of the main controlling unit 40 will be described below in detail. FIG. 2 is a block diagram showing functions of the image forming device 1.

As shown in FIG. 2, the main controlling unit 40 includes a count acquiring section 410, a determining section 420, a receiving processing section 430, a head controlling section 440, and a storing section 450.

The count acquiring section 410 acquires an element operation count of each of the elements 21 included in the inkjet head unit 20. The count acquiring section 410 acquires the element operation count per element 21. Then, the count acquiring section 410 calculates, based on the element operation count acquired currently and the element operation count acquired in the past, a cumulative value of the element operation count. The count acquiring section 410 maps the cumulative value of the element operation count with identification information of the corresponding element 21 that identifies the corresponding element 21, and stores the same in the storing section 450.

The determining section 420 determines whether the element operation count is equal to or greater than a life threshold count, and/or determines whether the element operation count is equal to or greater than a warning threshold count. Specifically, the determining section 420 determines whether the cumulative value of the element operation count acquired by the count acquiring section 410 is equal to or greater than the life threshold count, and/or determines whether the cumulative value of the element operation count is equal to or greater than the warning threshold count.

The life threshold count is a value corresponding to the life end point of the element 21 and is obtained in advance by conducting experiments and the like. The life threshold count is stored in advance in the storing section 450. The warning threshold count is a value that is smaller by a predetermined count than the life threshold count, and is stored in advance in the storing section 450. For example, the predetermined count is 10% of the life threshold count.

When the element operation count is equal to or greater than the warning threshold count, that is, when the element operation count reaches the warning threshold count, the receiving processing section 430 receives the instruction from the user whether an image should be formed by suppressing the element operation count. Specifically, when the cumulative value of the element operation count is equal to or greater than the warning threshold count, the receiving processing section 430 receives from the user a mode instruction data that indicates whether a suppression mode in which the element operation count is suppressed to form an image, or a normal mode in which an image is formed without suppressing the element operation count should be set for the current image forming.

The head controlling section 440 controls the inkjet head unit 20 to perform an image forming process that forms an image on the paper sheet P.

When the element operation count reaches or exceeds the warning threshold count and the receiving processing section 430 has received an instruction from the user that an image should be formed by suppressing the element operation count, the head controlling section 440 controls the inkjet head unit 20 to form an image by suppressing the element operation count. Specifically, when the cumulative value of the element operation count reaches or exceeds the warning threshold count and the receiving processing section 430 has received the mode instruction data that indicates the suppression mode in the current image forming, the head controlling section 440 controls the inkjet head unit 20 to form an image in the suppression mode.

When controlling the inkjet head unit 20 in the suppression mode, the head controlling section 440 generates modified image data in which the element operation count is suppressed for the current image forming by performing a pixel density reducing process that reduces the density of the image pixels, and controls the inkjet head unit 20 based on the generated modified image data.

The storing section 450 is constituted by a device such as a hard disk. The storing section 450 stores therein various pieces of information to be used in processes of the image forming device 1. The information stored in the storing section 450 is referred to by various sections of the main controlling unit 40. For example, the storing section 450 stores various screen data to be displayed on the operation panel 30. Moreover, the storing section 450 stores the cumulative value of the element operation count of each of the elements 21.

(Operation of Image Forming Device)

Figure 3:
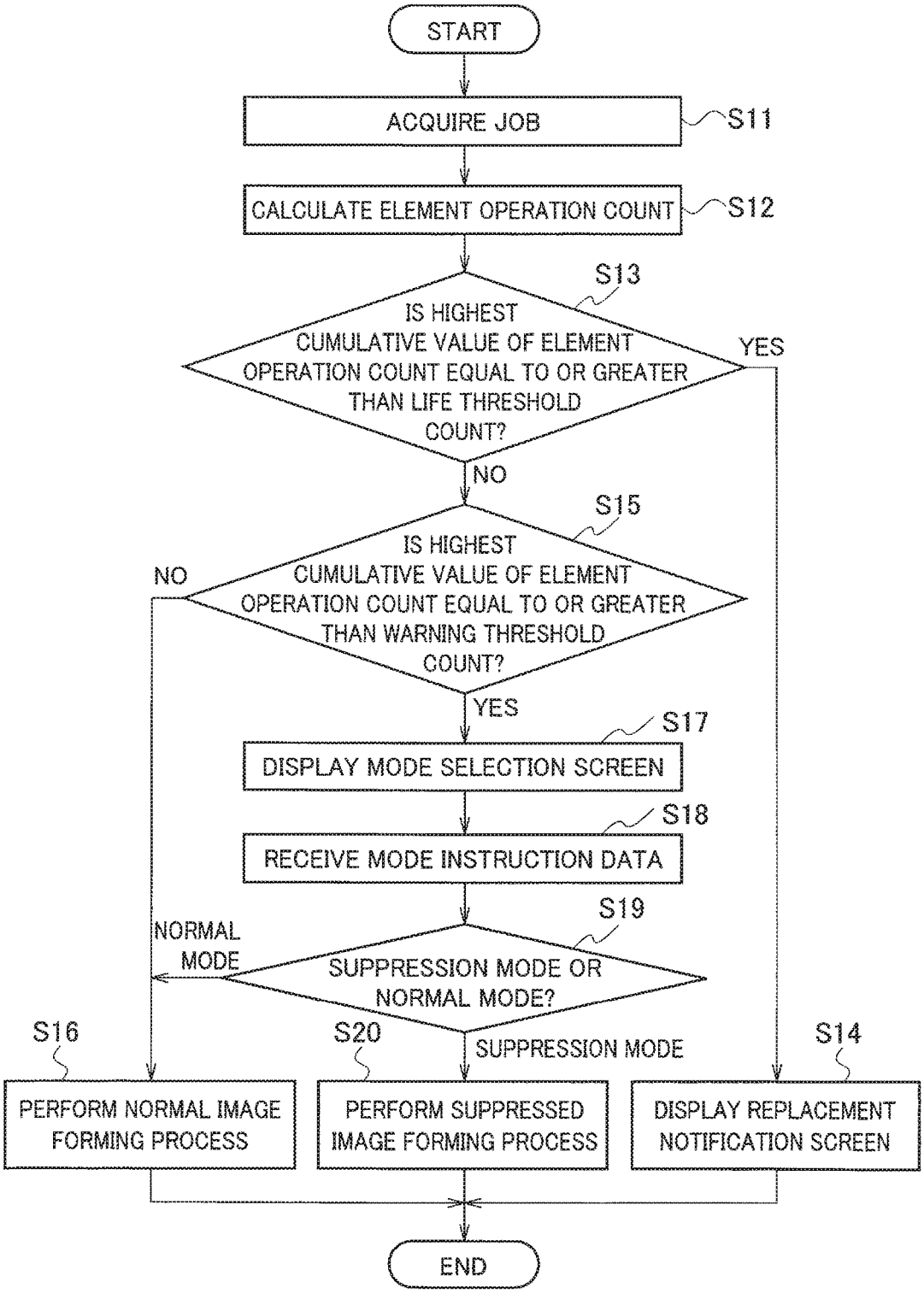
FIG. 3 is a flowchart of operations of the image forming device according to the first exemplary embodiment of the present invention.

Operation of the image forming device 1 will be described below. Specifically, operations to be performed when the image forming device 1 receives the job data will be described. FIG. 3 is a flowchart of operations of the image forming device 1.

First, at Step S11, in the image forming device 1, the main controlling unit 40 acquires the job data transmitted from the terminal device 2.

At Step S12, in the main controlling unit 40, the count acquiring section 410 acquires, based on the job data that instructs to form an image, the element operation count of each of the elements 21. Specifically, the count acquiring section 410 performs, based on the job data, RIP processing and the like to generate an image data that includes pixel values of pixels that constitute the image. To express an image shown in the image data, the count acquiring section 410 assesses element operation instruction data to be transmitted to the element 21 of each of the nozzles and counts the assessed element operation instruction data as the element operation count.

The count acquiring section 410 adds the element operation count currently acquired and the element operation count acquired in the past and stored in the storing section 450, and stores the cumulative value of the element operation count in the storing section 450.

At Step S13, the determining section 420 determines whether the element operation count is equal to or greater than the life threshold count that indicates the life end point of the inkjet head unit 20. Specifically, the determining section 420 determines whether the cumulative value of the element operation count acquired by the count acquiring section 410 is equal to or greater than the life threshold count. At this step, the determining section 420 determines whether the highest cumulative value of the element operation count among the cumulative values of the element operation counts stored for all the elements 21 is equal to or greater than the life threshold count.

Upon determining that the element operation count is equal to or greater than the life threshold count (Yes at Step S13), at Step S14, the determining section 420 causes the operation panel 30 to display thereon a replacement notification screen that indicates that the inkjet head unit 20 has reached the life end point and must be replaced. Then, the main controlling unit 40 prohibits the image forming process until the inkjet head unit 20 is replaced. Alternatively, the main controlling unit 40 can immediately prohibit the image forming process or can prohibit the image forming process after performing the current image forming process for which the job data was acquired.

On the other hand, upon determining that the element operation count is less than the life threshold count (No at Step S13), the determining section 420 determines, at Step S15, whether the element operation count is equal to or greater than the warning threshold count. Specifically, the determining section 420 determines whether the highest cumulative value of the element operation count is equal to or greater than the warning threshold count.

When the determining section 420 determines that the element operation count is less than the warning threshold count (No at Step S15), at Step S16, the head controlling section 440 performs a normal image forming process. Specifically, the head controlling section 440 performs the normal image forming process in which an image is formed based on the image data generated from the job data without suppressing the element operation count in the current image forming.

On the other hand, when the determining section 420 determines that the element operation count is equal to or greater than the warning threshold count (Yes at Step S15), at Step S17, the receiving processing section 430 displays a mode selection screen on the operation panel 30.

The mode selection screen is a screen for the user to select whether the normal mode or the suppression mode should be set. When the normal mode or the suppression mode is input by the user after the mode selection screen is displayed, the operation panel 30 transmits to the receiving processing section 430 the mode instruction data that instructs to set the mode input by the user, that is, the normal mode or the suppression mode.

At Step S18, the receiving processing section 430 receives the mode instruction data transmitted from the operation panel 30.

At Step S19, the head controlling section 440 determines whether the acquired mode instruction data instructs to set the normal mode or the suppression mode. The head controlling section 440 performs the normal image forming process as shown at Step S16 when the mode instruction data indicates the normal mode (Normal mode at Step S19).

On the other hand, when the mode instruction data indicates the suppression mode (Suppression mode at Step S19), at Step S20, the head controlling section 440 performs a suppressed image forming process that controls the inkjet head unit 20 in the suppression mode in the current image forming. Specifically, in the suppressed image forming process, the head controlling section 440 generates the modified image data by performing the pixel density reducing process on the image data generated based on the job data.

The pixel density reducing process is a process in which the density of each of the pixels that constitute the image is reduced in comparison to the image data generated based on the job data.

For example, to express color of each pixel of a monochrome image within the pixel value range of "0" to "255", the head controlling section 440 converts the pixel values such that the pixel density decreases by only a predetermined ratio. Specifically, if a pixel value of a predetermined pixel is "40", the head controlling section 440 converts, by using the predetermined ratio, the pixel value to "120" such that the pixel density becomes one-third thereof. Because, as a result, the number of ink dots discharged from the nozzle for expressing the color of the predetermined pixel is reduced, the element operation count of the element 21 corresponding to that nozzle, too, can be reduced.

The head controlling section 440 converts the image data by performing the pixel density reducing process, generates the modified image data, and forms an image based on the generated modified image data.

(Effects and Advantages)

As described above, in the image forming device 1 according to the first exemplary embodiment of the present invention, the count acquiring section 410 acquires the element operation count of each of the elements 21, and the determining section 420 determines whether the highest cumulative value of the element operation count among the cumulative values of the element operation counts stored for the elements 21 is equal to or greater than the warning threshold count. When the highest cumulative value of the element operation count is equal to or greater than the warning threshold count, the receiving processing section 430 receives from the user the mode instruction data that instructs whether the suppression mode or the normal mode should be set. The head controlling section 440 controls, based on the mode instruction data, the inkjet head unit 20 to form an image either in the suppression mode or the normal mode.

Accordingly, in the image forming device 1, because the suppression mode in which the element operation count is suppressed can be selected for the current image forming when the highest cumulative value of the element operation count has reached or exceeded the warning threshold count, the life of the inkjet head unit 20 can be extended at a time point before the life end point. Therefore, according to the image forming device 1, even after the highest cumulative value of the element operation count reaches or exceeds the warning threshold count and the inkjet head unit 20 nears the life end point, printing can be continued for a longer time without remarkably lowering the print quality.

Figure 4A:
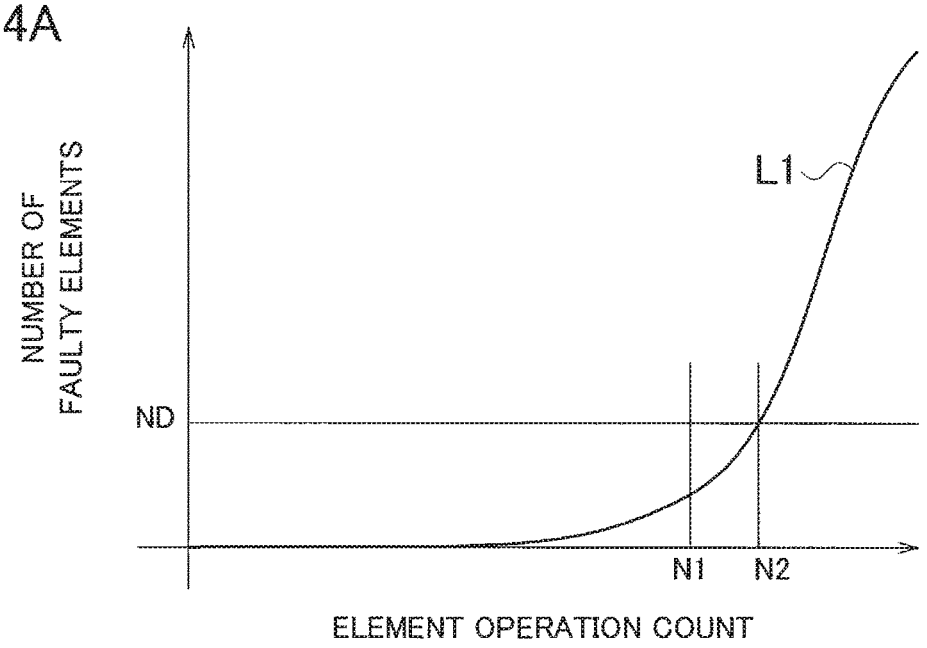
FIG. 4A is a graph for explaining an example of a relationship between a cumulative value of an element operation count and the number of faulty elements.
Figure 4B:
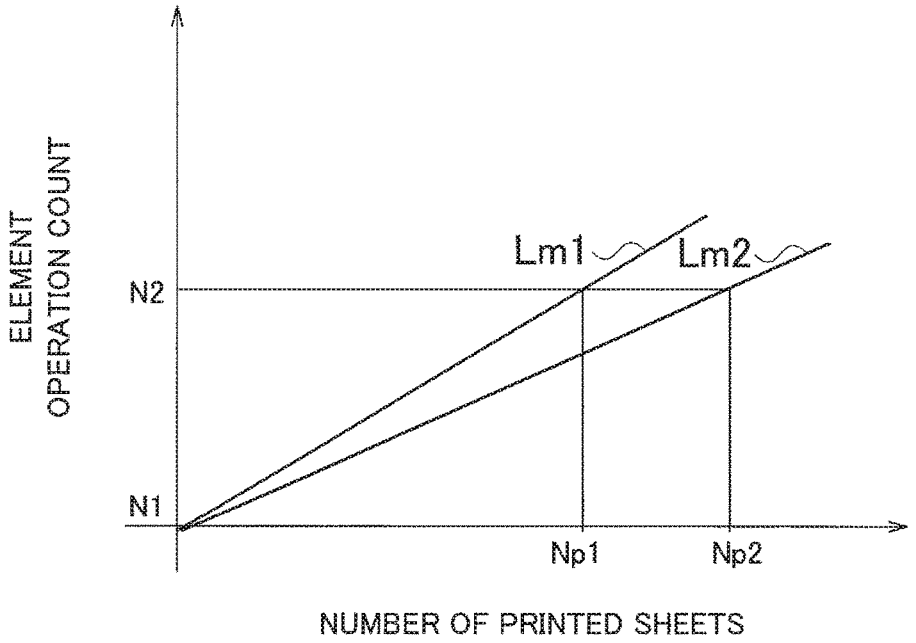
FIG. 4B is a graph for explaining an example of a relationship between the number of printed sheets and the cumulative value of the element operation count.

FIG. 4A is a graph showing a relationship between the cumulative value of the element operation count of the element 21 and the number of faulty elements 21 included in the inkjet head unit 20, and FIG. 4B is a graph showing a relationship between the number of sheets printed by the image forming device 1 and the cumulative value of the element operation count of the element 21. Note that the cumulative value of the element operation count (hereinafter appropriately simply referred to as the element operation count) shown in FIGS. 4A and 4B indicates the highest cumulative value of the element operation count among the cumulative values of the element operation counts for all the elements 21 included in the inkjet head unit 20.

As shown in FIG. 4A, it is known that there is a roughly predictable correlation between the element operation count of the element 21 and the number of faulty elements 21. Therefore, when only the normal image forming process is performed, the correlation is as shown by a curve L1.

As shown in FIG. 4A, at the time of performing the normal image forming process, when the element operation count has reached N2, the number of faulty elements 21 has reached ND that is the number of faulty elements 21 for which replacement of the inkjet head unit 20 is required. That is, the inkjet head unit 20 reaches its life end point.

On the other hand, in the image forming device 1 according to the first exemplary embodiment of the present invention, as shown in FIG. 4A, the life threshold count N2 which is an element operation count corresponding to the life end point and a warning threshold count N1 which is smaller than the life threshold count N2 are stipulated, and the suppressed image forming process that forms an image in the suppression mode when the element operation count reaches the warning threshold count N1, can be performed.

Accordingly, it is possible to adjust the number of sheets to be printed during a period from the point when the element operation count reaches the warning threshold count N1 till the point when the same reaches the threshold count N2. Specifically, as shown in FIG. 4B, because the element operation count goes on increasing along a straight line Lm1 when the normal mode is specified and the normal image forming process is performed, the element operation count reaches the life threshold count N2 when the number of printed sheets is Np1. On the other hand, because the element operation count increases gently along a straight line Lm2 having a smaller inclination when the suppression mode is specified and the suppressed image forming process is performed, the element operation count reaches the life threshold count N2 when the number of printed sheets is Np2 which is plotted after the number of printed sheets Np1.

In this manner, the number of printed sheets until the element operation count reaches the life threshold count N2, which is an element operation count corresponding to the life end point, can be increased. In other words, life of the inkjet head unit 20 can be extended.

Moreover, in the image forming device 1, when the highest cumulative value of the element operation count has reached or exceeded the warning threshold count, the normal mode in which the element operation count is not suppressed can be selected for the current image forming. Therefore, in the current image forming, an image can be formed by retaining the image quality without suppressing the element operation count. This increases the degree of freedom of selection and improves convenience offered to the user.

Note that, in the first exemplary embodiment described above, the operations of the receiving processing section 430 executed at Steps S17 to S19 are not absolutely necessary. For example, when the determining section 420 determines that the highest cumulative value of the element operation count has reached or exceeded the warning threshold count (Yes at Step S15), the control can proceed to Step S20 and the head controlling section 440 may perform, in the current image forming, the suppressed image forming process that controls the inkjet head unit 20 in the suppression mode. In other words, when the highest cumulative value of the element operation count is equal to or greater than the warning threshold count, in the current image forming, the head controlling section 440 may always control the inkjet head unit 20 to form an image by suppressing the element operation count.

In the image forming device 1, when the highest cumulative value of the element operation count is equal to or greater than the warning threshold count, in other words, when the highest cumulative value of the element operation count reaches the warning threshold count, the element operation count is suppressed in the current image forming without receiving an instruction from the user. With such a configuration, the increase pace of the element operation count can be suppressed more reliably, and the period until the element operation count reaches the life threshold count can be extended more reliably.

First Modification

An image forming device 1 according to a first modification of the first exemplary embodiment of the present invention will be described below.

In the first exemplary embodiment described above, when controlling the inkjet head unit 20 in the suppression mode, the head controlling section 440 performs the pixel density reducing process in which the pixel density of the image data is reduced, to generate the modified image data in which the element operation count is suppressed. In contrast, in the first modification, the head controlling section 440 generates, by performing a thinning process that thins out the pixels that constitute an image, the modified image data in which the element operation count is suppressed, and controls the inkjet head unit 20 based on the generated modified image data.

Figure 5A:
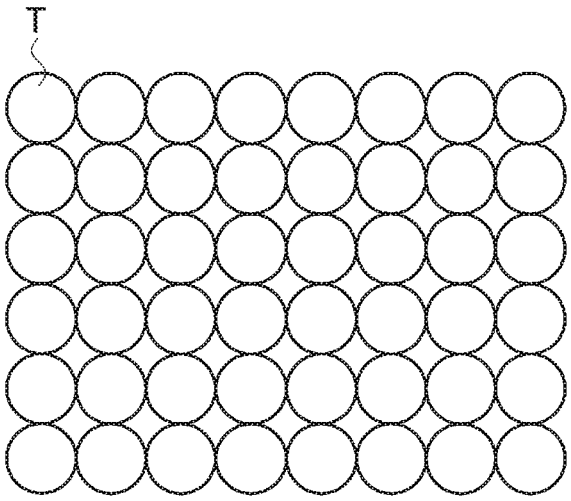
FIG. 5A is a schematic image obtained from image data before a thinning process is performed according to a first modification of the first exemplary embodiment of the present invention.
Figure 5B:
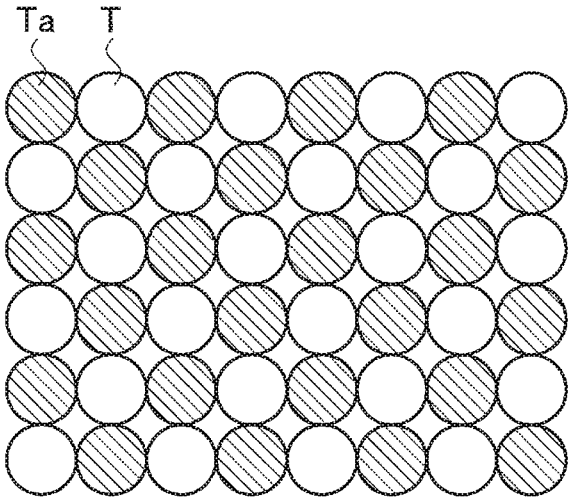
FIG. 5B is a schematic image obtained from modified image data generated after the thinning process is performed according to the first modification of the first exemplary embodiment of the present invention.

FIG. 5A is a schematic image obtained from image data before the thinning process is performed, and FIG. 5B is a schematic image obtained from the modified image data generated after the thinning process is performed. In FIGS. 5A and 5B, un-thinned pixels T that have not been thinned and thinned pixels Ta that have been thinned are shown.

In the thinning process, for each of the pixels T included in the image data, the head controlling section 440 allocates, alternately in the left-right and the up-down directions, one thinned pixel Ta for which the density of the pixel value is reduced to zero to generate the modified image data. For example, the head controlling section 440 allocates a pixel value of "255" that indicates "white" as the thinned pixel Ta.

As described above, in the image forming device 1 according to the first modification, in the suppressed image forming process performed when the suppression mode is set, the modified image data is generated by performing the thinning process, and an image is formed based on the generated modified image data.

Accordingly, the element operation count of the element 21 of the nozzle can be reduced because the number of ink dots is reduced wherein the ink dots are formed by discharge of the ink from one nozzle to express the color of the pixels.

Second Modification

An image forming device 1 according to a second modification of the first exemplary embodiment of the present invention will be described below.

In the first embodiment described above, when the user inputs an instruction in the operation panel 30, the receiving processing section 430 receives the mode instruction data. In the second modification, the receiving processing section 430 receives mode instruction data when the user inputs an instruction in the terminal device 2 at the time of generating job data in the terminal device 2.

Figure 6:
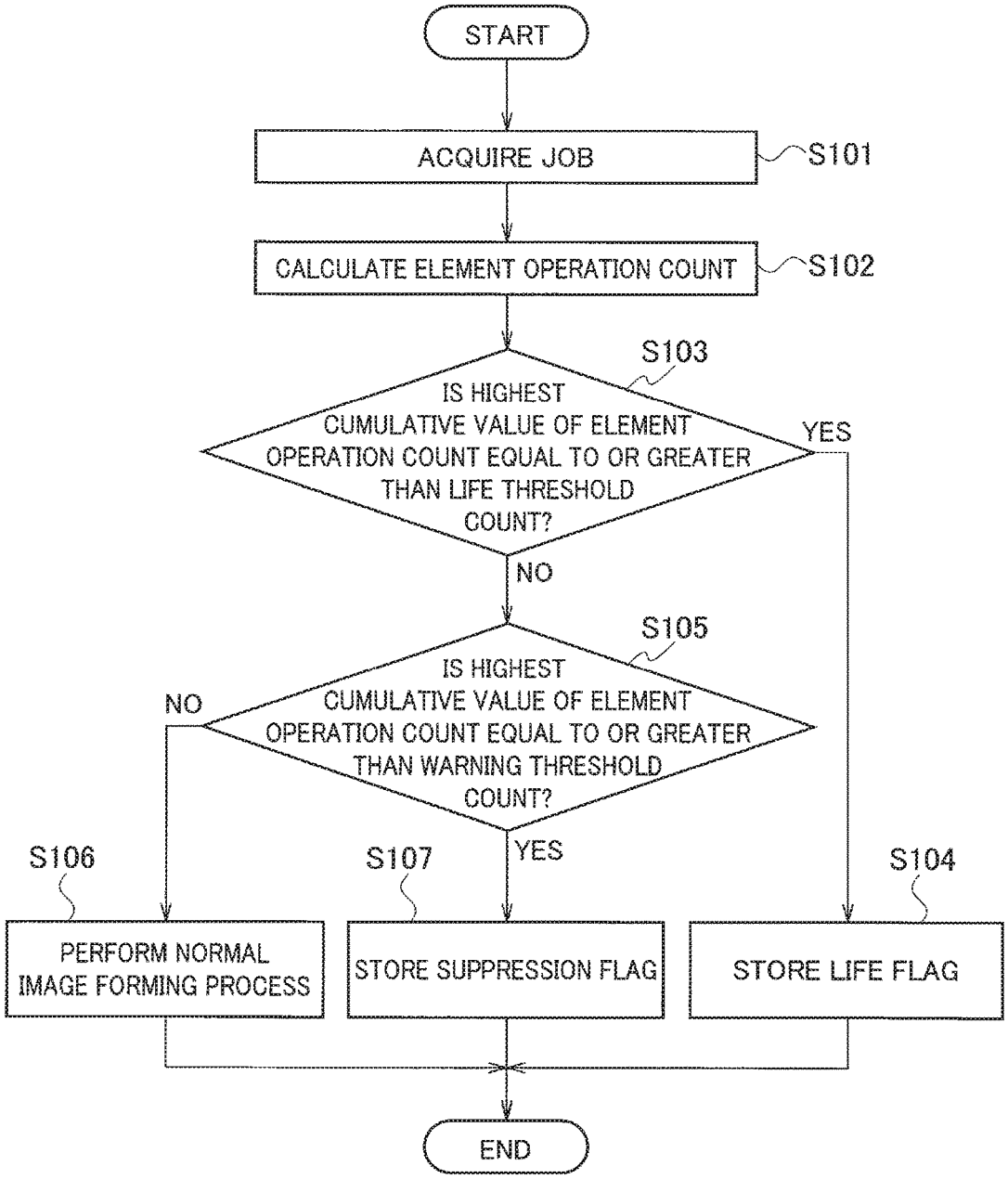
FIG. 6 is a flowchart of operations of an image forming device according to a second modification of the first exemplary embodiment of the present invention.

First, operation performed when the image forming device 1 has received the job data will be described. FIG. 6 is a flowchart of operations of the image forming device 1.

Note that, the operations performed at Steps S101 to S103 are the same as those performed at Steps S11 to S13 shown in FIG. 3 and description thereof is omitted.

When the determining section 420 determines that the highest cumulative value of the element operation count is equal to or greater than the life threshold count (Yes at Step S103), at Step S104, the storing section 450 stores a life flag that indicates that the inkjet head unit 20 has reached the life end point.

On the other hand, when the determining section 420 determines that the highest cumulative value of the element operation count is less than the life threshold count (No at Step S103), at Step S105, the determining section 420 determines whether the highest cumulative value of the element operation count is equal to or greater than the warning threshold count.

When the determining section 420 determines that the highest cumulative value of the element operation count is less than the warning threshold count (No at Step S105), at Step S106, the head controlling section 440 performs the normal image forming process.

On the other hand, when the determining section 420 determines that the highest cumulative value of the element operation count is equal to or greater than the warning threshold count (Yes at Step S105), at Step S107, the storing section 450 stores therein a suppression flag.

Figure 7:
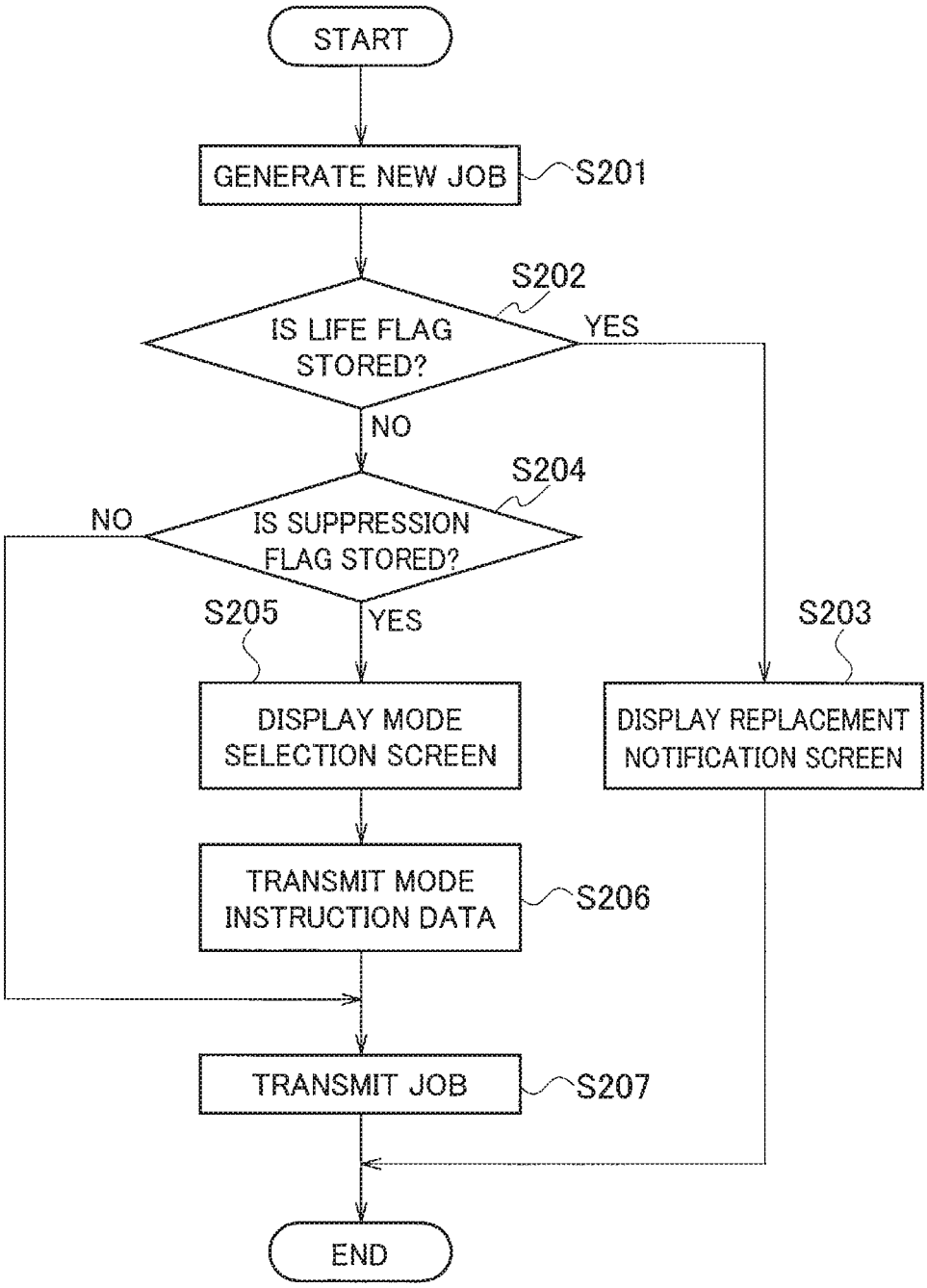
FIG. 7 is a flowchart of operations of a terminal device according to the second modification of the first exemplary embodiment of the present invention.

Operations performed when the terminal device 2 generates new job data will be described below. FIG. 7 is a flow chart of operations performed by the terminal device 2.

At Step S201, the terminal device 2 generates the new job data.

At Step S202, the terminal device 2 determines whether the life flag has been stored in the storing section 450 of the image forming device 1.

When the life flag has been stored (Yes at Step S202), at Step S203, the terminal device 2 causes a display unit (not shown) thereof to display thereon a replacement notification screen that indicates that the inkjet head unit 20 has reached the life end point and must be replaced.

On the other hand, upon determining that the life flag is not stored (No at Step S202), at Step S204, the terminal device 2 determines whether the suppression flag has been stored in the storing section 450 of the image forming device 1. When the suppression flag is not stored (No at Step S204), at Step S207, the terminal device 2 transmits the job data to the image forming device 1.

On the other hand, when the suppression flag has been stored (Yes at Step S204), at Step S205, the terminal device 2 causes the display unit (not shown) thereof to display a mode selection screen thereon. Then, the terminal device 2 prompts a user to input whether the normal mode or the suppression mode should be set.

At Step S206, the terminal device 2 transmits to the receiving processing section 430 of the image forming device 1 the mode instruction data that instructs to set either the normal mode or the suppression mode input by the user. Accordingly, the receiving processing section 430 receives the mode instruction data.

At Step S207, the terminal device 2 transmits the job data. After this operation, the operations of Steps S19 and onwards shown in FIG. 3 are executed in the image forming device 1 that has received the job data and the mode instruction data.

In this manner, in the image forming device 1 according to the second modification, based on whether the suppression flag or the life flag has been stored, the terminal device 2 can display the mode selection screen thereon and transmit the mode instruction data to the image forming device 1. Accordingly, the user can easily grasp via the terminal device 2 that the inkjet head unit 20 has reached the life end point or has reached a warning threshold period from which the life end point is near.

Third Modification

An image forming device 1 according to a third modification of the first exemplary embodiment of the present invention will be described below.

In the first embodiment described above, when controlling the inkjet head unit 20 in the suppression mode, the head controlling section 440 performs the pixel density reducing process in which the pixel density of the image data is reduced to generate the modified image data in which the element operation count is suppressed.

In the third modification, the head controlling section 440 performs, after performing the pixel density reducing process in which the pixel density of the image data is reduced, an error diffusion process to generate the modified image data.

Specifically, in the suppressed image forming process performed at Step S20 in FIG. 3 described above, when the mode instruction data indicates the suppression mode (suppression mode at Step S19), the head controlling section 440 performs the pixel density reducing process on the image data generated based on the job data. Then, the head controlling section 440 further performs the error diffusion process to generate the modified image data.

In this manner, in the image forming device 1 according to the third modification, when controlling the inkjet head unit 20 in the suppression mode, the element operation count can be suppressed by performing the pixel density reducing process and, simultaneously, the gradations of the image can be expressed smoothly by performing the error diffusion process. With this configuration, while extending the life of the inkjet head unit 20, lowering of the image quality due to the suppression of the element operation count can be suppressed.

Other Embodiments of Present Invention

Although exemplary embodiments of the present invention are described above, it is obvious for a person skilled in the art that the present invention is not limited to the embodiments described in the present specification.

For example, in the embodiments described above, the image forming device 1 is described by citing an example of an inkjet type configuration; however, the present invention is not particularly limited to such a configuration as long as the image forming device includes a head unit having an element that forms an image. For example, the image forming device 1 can be a stencil printing machine that includes a head unit having an element and forms an image on a master (stencil) by an element operation of the element. In such a configuration, the element is a heat element that forms an image on the master by using thermic perforation.

Moreover, in the embodiments described above, an image forming device 1 in which the color of the ink discharged from the inkjet head unit 20 is black, is cited as an example. However, the ink may be of colors such as Cyan (C), Magenta (M), Yellow (Y), and Black (K).

Accordingly, the present invention is not limited to the above embodiments, and, when implementing the present invention, the structural elements can be modified in various manners without departing from the gist of the present invention. Moreover, various inventions can be formed by appropriately combining the various structural elements disclosed in the embodiments described above. For example, some structural elements may be omitted from all the structural elements disclosed in the embodiments.

What is claimed is:

1. An image forming device that forms an image by an ink-discharging operation of an ink-discharging element, comprising:

an ink-discharging head including the ink-discharging element; and a processor that acquires a count of the number of ink-discharging operations of the ink-discharging element based on job data that instructs the image forming device to form the image, determines whether the acquired count is equal to or greater than a warning threshold count, the warning threshold count being smaller by a predetermined count than a life threshold count of the number of ink-discharging operations at which the ink-discharging element reaches the end of its life, and controls the ink-discharging head to form the image by reducing the number of ink-discharging operations of the ink-discharging element when the acquired count is equal to or greater than the warning threshold count.

2. The image forming device according to claim 1, wherein, when controlling the ink-discharging head to form the image by reducing the number of ink-discharging operations of the ink-discharging element, the processor performs either a thinning process in which pixels that constitute the image are thinned out or a pixel density reducing process in which pixel density of the image is reduced, to generate from the job data modified image data in which the number of ink-discharging operations of the ink-discharging element is reduced, and controls the ink-discharging head based on the generated modified image data.

3. The image forming device according to claim 2, wherein the processor receives an instruction from a user that the image is to be formed by reducing the number of ink-discharging operations of the ink-discharging element when the acquired count is equal to or greater than the warning threshold count, and controls the ink-discharging head to form the image by reducing the number of ink-discharging operations of the ink-discharging element when the acquired count reaches or exceeds the warning threshold count and the processor receives from the user the instruction that the image is to be formed by reducing the number of ink-discharging operations of the ink-discharging element.

4. The image forming device according to claim 2, wherein the life threshold count is an accumulated count of the number of ink-discharging operations from a starting point for counting the number of the ink-discharging operations to a life end point when the ink-discharging element deteriorates to stop functioning properly.

5. The image forming device according to claim 1, wherein the processor receives an instruction from a user that the image is to be formed by reducing the number of ink-discharging operations of the ink-discharging element when the acquired count is equal to or greater than the warning threshold count, and controls the ink-discharging head to form the image by reducing the number of ink-discharging operations of the ink-discharging element when the acquired count reaches or exceeds the warning threshold count and the processor receives from the user the instruction that the image is to be formed by reducing the number of ink-discharging operations of the ink-discharging element.

6. The image forming device according to claim 1, wherein the life threshold count is an accumulated count of the number of ink-discharging operations from a starting point for counting the number of the ink-discharging operations to a life end point when the ink-discharging element deteriorates to stop functioning properly.

* * * * *